United States Patent [19]

Winslow

[11] Patent Number: 4,754,376

[45] Date of Patent: Jun. 28, 1988

[54] AUTOMATIC ICE CHEST LIGHT

[76] Inventor: Charles H. Winslow, 4770 N. 7th St., #1125, Phoenix, Ariz. 85014

[21] Appl. No.: 113,057

[22] Filed: Oct. 27, 1987

[51] Int. Cl.[4] ..... F21V 33/00

[52] U.S. Cl. ..... 362/92; 362/154; 362/191; 362/427; 362/802

[58] Field of Search ..... 362/92, 154, 155, 156, 362/190, 191, 394, 403, 427, 802, 430, 94

[56] References Cited

U.S. PATENT DOCUMENTS 1,906,131 4/1933 Baylis .
2,156,462 5/1939 Schulte .
2,448,080 8/1948 Cobbs .
2,644,882 7/1953 Voda .
2,801,330 7/1957 Gay .
4,577,262 3/1986 Buteaux ..... 362/155

*Primary Examiner*—Stephen F. Husar
*Attorney, Agent, or Firm*—Norman B. Rainer

[57] ABSTRACT

A battery operated lighting device is provided for removable attachment to the underside of the pivoted lid of a top-loading ice chest. When the lid is raised, the light is automatically activated by a position-sensing switch. The device is comprised of a holding bracket and a housing rotatively and removably held by the bracket. When removed from the holding bracket, the housing can function as an ordinary flash light.

12 Claims, 2 Drawing Sheets

AUTOMATIC ICE CHEST LIGHT

BACKGROUND OF THE INVENTION

This invention concerns a device for illuminating the interior of an opened ice chest and capable of being automatically deactivated by the closing of a closure lid of the ice chest.

Top-loading portable ice chests are in widespread use, said ice chests being comprised of an open-topped thermally insulated box-like storage compartment and a closure lid attached by horizontally disposed hinge means to the top of the storage compartment. When such ice chests are used during hours of darkness, as by campers, fisherman, boaters and others, it is often difficult to identify within the ice chest specific items such as a particular flavor or brand of beverage.

When a hand-held light is employed, the user must manipulate items within the chest with just one hand. This presents difficulties, especially when large or slippery items such as blocks of ice must be moved in order to find other items within the chest. The problem is particularly acute when the user's other hand must hold the lid open.

Lighting devices have heretofore been disclosed for illuminating box-like enclosures such as refrigerators, storage chests and closets, said devices being activated when a lid or other closure means is opened. Examples of such devices are disclosed in U.S. Pat. Nos. 1,906,131; 2,156,462; 2,448,080; 2,644,882; 2,801,330; and 4,577,262. In general, such prior art lighting devices are incorporated into the enclosures by virtue of specialized design of the enclosure to accommodate the lighting device at the time of factory manufacture. Accordingly, the cost of the enclosure is increased, and the purchaser has no option as to whether or not he wants the lighting device.

U.S. Pat. No. 2,156,462 to Schulte discloses a battery operated lighting device which may be easily emplaced in a refrigerator by the owner. The Schulte device is installed upon a horizontal shelf, and is positioned such that, when the vertically pivoted door of the refrigerator closes, it contacts a spring-biased plunger which turns the light off. The type of lighting device disclosed by Schulte is not applicable to ice chests because it would have to be supportively positioned within the storage compartment for interaction with the horizontally pivoted lid. Such positioning would interfere with normal use of the ice chest and would require resistance to water immersion and impact damage.

Prior lighting devices for enclosures have been so specialized that alternative uses are not feasible, and many lack adjustability of light distribution in their installed positions.

It is accordingly an object of the present invention to provide a lighting device for an ice chest that can be readily installed by the owner.

It is another object of this invention to provide a lighting device as in the foregoing object compatible with normal use of the ice chest.

It is a further object of the present invention to provide a lighting device of the aforesaid nature having versatility of use beyond dedicated installation within an icē chest.

It is a still further object of this invention to provide a lighting device of the aforesaid nature capable of providing adjustability of light distribution.

It is yet another object of the present invention to provide a lighting device of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a lighting device comprising:

(a) a holding bracket comprised of a base panel having a flat rear mounting surface and an opposed front surface, and two arms extending perpendicularly from said front surface in parallel spaced apart relationship, each arm being provided with first circular retaining means, the retaining means of both arms being centered upon a common axis parallel to said base panel.

(b) a housing comprised of upper, lower and rear panel structure and two flat side panels, said panels defining an enclosure having an open forward extremity of rectangular coplanar perimeter, said side panels being provided with second circular retaining means centered upon an axis parallel to said rectangular perimeter and adapted to removably interengage said first retaining means to permit pivotal movement of the housing within the bracket and removal of the housing from the bracket, (c) battery holding means disposed within said housing, (d) light reflecting means removably attached to the open perimeter of said housing, (e) a light bulb activatable by batteries and positioned within said reflecting means, (f) first switch means for automatically controlling operation of the light bulb based upon the angle of tilt of the perimeter of the housing, whereby the light is off when the plane of said perimeter is horizontally disposed and is on at an angle between 60 and 120 degrees relative to horizontal, (g) second switch means for manually controlling operation of the light bulb while deactivating said first switch means, and (h) electrical conductor means interconnecting said battery compartment, bulb and switch means.

In preferred embodiments, the bracket is of monolithic construction, having been fabricated by molding from a synthetic plastic. The flat rear mounting surface may be provided wtih attachment means in the form of a layer of contact adhesive and peel-off release paper, thereby enabling the bracket to be adhered to the underside of the lid of an ice chest. Alternatively, magnetic attachment means or Velcro may be associated with said rear mounting surface. The arms of the bracket preferably have resiliency by virtue of the properties of the plastic to undergo sufficient outward displacement to enable the housing to be inserted into and removed from the bracket. In alternative embodiments, the holding bracket, or equivalent means may be incorporated into the underside of the lid.

The housing may also be of monolithic molded construction. The junctures of the rear panel portion with the upper and lower panel portions is preferably rounded, thereby permitting the housing to be rotatively positioned close to the base panel of the holding bracket. In some embodiments, the housing may be adapted to pivot freely within the bracket.

The light reflecting means preferably attaches to the open perimeter of the housing by way of snap-in-place interactive projections and/or recesses integral with the housing and reflecting means. The light reflecting means may have an auxiliary enclosure to accomodate said switch means. A transparent cover, which may contain lens means, may be removably affixed to the light reflecting means.

The first switch means may be a mercury-containing switch wherein the gravity influenced flow of the mercury causes the opening or closing of an electrical circuit. Said first switch means is preferably mounted within the housing.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
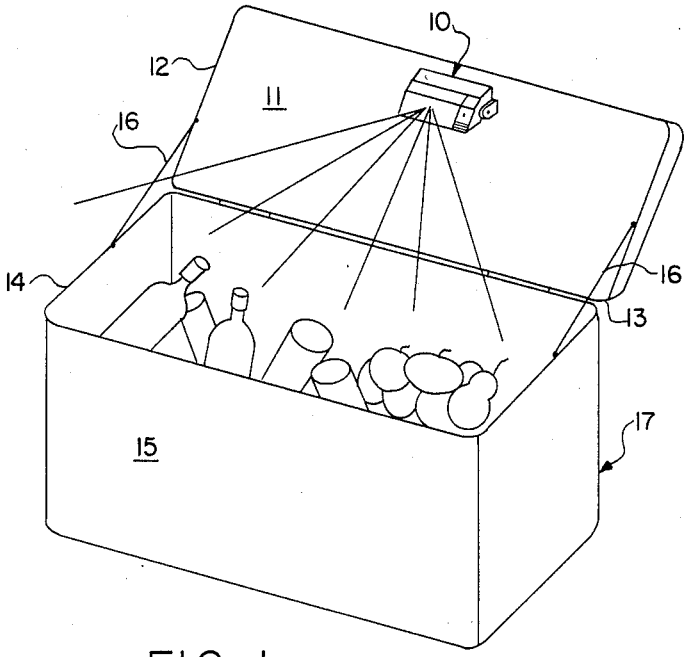
FIG. 1 is a side view showing an embodiment of the lighting device of the present invention operatively associated with the lid of a top-loading ice chest.

Referring to FIG. 1, an embodiment of the lighting device 10 of this invention is shown attached to the underside surface 11 of the lid 12 of ice chest 17. The lid is attached by horizontally disposed hinge 13 to the upper perimeter 14 of box-like storage compartment 15. A limiting chain 16 controls the extent of rearward movement of the lid in the opened state of the ice chest.

Figure 2:
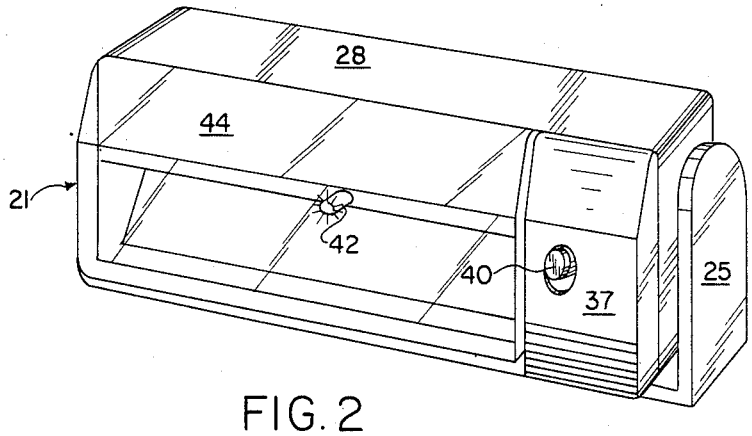
FIG. 2 is a perspective view of an embodiment of a lighting device of this invention.
Figures 3, 4:
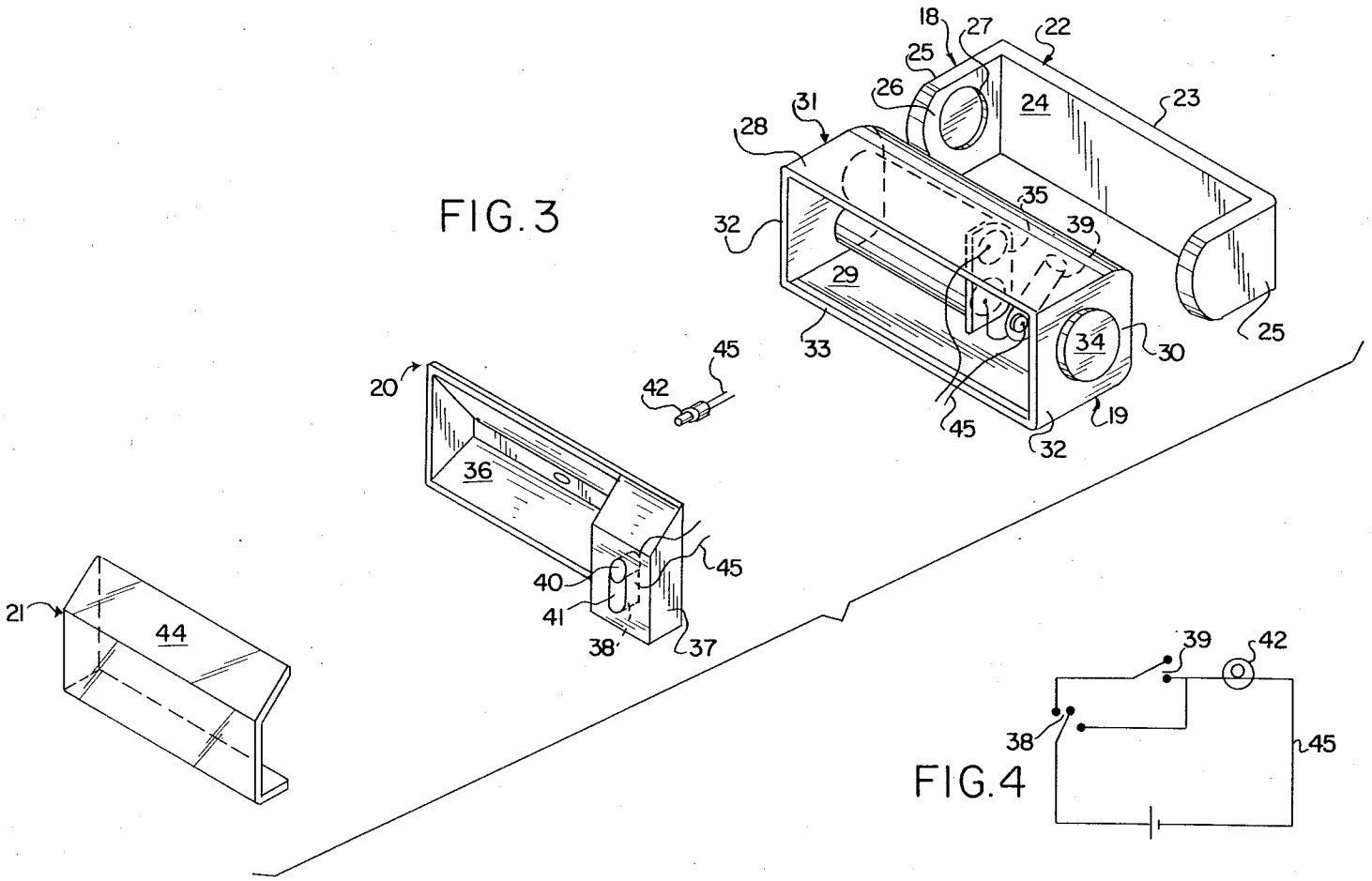
FIG. 3 is an exploded view of the embodiment of FIG. 2.
FIG. 4 is a schematic drawing of the electrical circuitry of the device of FIG. 2.

Referring to FIGS. 2 and 3, the lighting device is shown genreally comprised of holding bracket 18, housing 19 rotatably held by said bracket, light reflector 20 attached to said housing, and transparent cover 21 disposed upon the forward extremity of said reflector.

The exemplified embodiment of holding bracket 18 is of monolithic construction, fabricated of a strong thermoplastic polymer. Said holding bracket is comprised of base panel 22 having flat rear mounting surface 23 and opposed front surface 24, and paired arms 25 extending perpendicularly from said front surface in parallel, spaced apart relationship. The facing interior surfaces 26 of said arms contain first circular retaining means in the form of depressions 27 which are centered upon a common axis parallel to said base panel. Mounting surface 23 is adapted to fit flush against underside surface 11 of the lid, and may be provided with contact-type adhesive.

The exemplified embodiment of housing 19 is of monolithic construction, fabricated of a thermoplastic polymer such as may be used to fabricate bracket 18. Housing 19 is comprised of upper, lower and rear portions, 28, 29 and 30, respectively, of U-shaped panel structure 31, and opposed side panels 32. Said side panels and panel structure 31 define an enclosure having an open forward extremity 33 of rectangular coplanar perimeter. Side panels 32 are each provided with second circular retaining means in the form of boss 34 directed outwardly from the enclosure and adapted to releasibly and rotatively engage depressions 27 of said bracket.

Battery holding means 35, adapted to confine one or more dry cell batteries, is disposed upon rear portion 30 within said enclosure. Said battery holding means may be a continuous integral extension of housing 19. A mercury activated position switch, schematically represented by numeral 39, is attached to rear portion 30.

Light reflector 20 is adapted to removably engage forward extremity 33 by virtue of snap-in-place geometrical features associated with both the reflector and housing. Reflector 20 accordingly has a generally rectangular periphery, and has a forwardly directed trough-shaped internal region 36 whose surface is reflective. The reflector in the exemplified embodiment is fabricated of plastic, and the reflective surface is a metal coating which may be produced by vacuum sputtering treatment with aluminum wet plating with nickel, or other known techniques, or may be a metallized adhesive tape. Light bulb 42, activatable by said batteries, is centrally positioned within internal region 36.

An auxiliary enclosure 37 is associated with the forwardly-directed portion of reflector 20. Confined within enclosure 37 is a manual on-off switch schematically represented by numeral 38. A control button 40, slidably positioned within vertically elongated slot 41 in enclosure 37, enables the user to select modalities wherein the light bulb may be on, off, or controlled by gravity-operated switch 39.

Transparent cover 21, disposed forwardly of trough-shaped region 36, has a flat upper panel 44 adapted to display advertising indicia.

Electrical conductor wires 45 interconnect the batteries, light bulb and switches. An electrical circuit schematic diagram is shown in FIG. 4.

By virtue of the specialized design and construction of the lighting device of this invention, the gravity switch conserves battery power when the lid of the ice chest is closed. Additional energy conservation may be achieved by the manual on-off switch which enables the user to deactivate the bulb during daylight hours. A photo sensor may be additionally incorporated to automatically keep the bulb off in daylight. Because the housing can be easily removed and used independently of the ice chest, the lighting device has enhanced versatility of use for outdoorsmen.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An illumination device adapted for attachment to the top lid of a chest comprising: a housing, pivot means for securing said housing to the lid on a substantially horizontal axis when the lid is in closed position, a reflector in the housing shaped to project a generally rectangular beam of light, a light bulb within the reflector space, means for connecting said light bulb to a power source including a gravity activated on and off switch, which remains in the closed circuit position while the housing is in a predetermined angle range of tilt from the horizontal.

2. The illuminating device of claim 1 wherein the means connecting said light source to a power source includes a manually operated on and off switch.

3. An automatic lighting device for illuminating the interior of an opened top loading ice chest having an open-topped insulated box-like storage compartment and a lid attached by horizontally disposed hinge means to the top of said compartment, said lighting device comprising:

(a) a holding bracket comprised of a base panel having a flat rear mounting surface and an opposed front surface, and two arms extending perpendicularly from said front surface in parallel spaced apart relationship, each arm being provided with first circular retaining means, the retaining means of both arms being centered upon a common axis parallel to said base panel, (b) a housing comprised of upper, lower and rear panel structure and two flat side panels, said panels defining an enclosure having an open forward extremity of rectangular copolanar perimeter, said side panels being provided with second circular retaining means centered upon an axis parallel to said rectangular perimeter and adapted to removably interengage said first retaining means to permit pivotal movement of the housing within the bracket and removal of the housing from the bracket, (c) battery holding means disposed within said housing, (d) light reflecting means removably attached to the open perimeter of said housing, (e) a light bulb activatable by batteries and positioned within said reflecting means, (f) first switch means for automatically controlling operation of the light bulb based upon the angle of tilt of the plane of the perimeter of the housing, whereby the light is off when said plane is horizontally disposed, and is on at an angle between 60 and 120 degrees relative to horizontal.

(g) second switch means for manually controlling operation of the light bulb while deactivating said first switch means, and (h) electrical conductor means interconnecting said battery compartment, bulb and switch means.

4. The lighting device of claim 3 wherein said holding bracket is of monolithic construction, having been fabricated by molding from a synthetic plastic.

5. The lighting device of claim 4 wherein the flat rear mounting surface of said holding bracket is provided with attachment means.

6. The lighting device of claim 5 wherein said attachment means is a layer of contact adhesive.

7. The lighting device of claim 4 wherein said arms have sufficiently resilient properties to permit the housing to be inserted into and removed from the bracket.

8. The lighting device of claim 4 wherein the housing is of monolithic construction, having been fabricated by molding from a synthetic plastic.

9. The lighting device of claim 8 wherein said light reflecting means attaches to the open perimeter of the housing by way of snap-in-place interactive projections and recesses integral with the housing and reflecting means.

10. The lighting device of claim 3 having an auxiliary enclosure which accommodates said switch means.

11. The lighting means of claim 3 having a transparent cover removably affixed to the light reflecting means.

12. In a top loading ice chest having an open top insulated box-like storage compartment and a lid attached by horizontally disposed hinge means to the top of said compartment such that the underside of said lid is directed toward said compartment in the closed state of the ice chest, the improvement comprising a lighting device of claim 1 attached to the underside of said lid in a manner such that the axis of said second circular retaining means is parallel to said hinge means.

* * * * *